US007717044B2

(12) United States Patent
Hatton

(10) Patent No.: US 7,717,044 B2
(45) Date of Patent: May 18, 2010

(54) SPLIT-LEVEL BAR COUNTER

(75) Inventor: Anthony James Hatton, Kowloon (HK)

(73) Assignee: Sparkling Wine International, Road Town, Tortola (VG)

( * ) Notice: Subject to any disclaimer, the term of this patent is extended or adjusted under 35 U.S.C. 154(b) by 358 days.

(21) Appl. No.: 11/801,396

(22) Filed: May 9, 2007

(65) Prior Publication Data

US 2007/0267452 A1 Nov. 22, 2007

(30) Foreign Application Priority Data

May 10, 2006 (HK) ..... 1084287

(51) Int. Cl.
*A47B 23/04* (2006.01)

(52) U.S. Cl. ..... 108/92; 312/140.2

(58) Field of Classification Search ... 312/140.1–140.4, 312/235.1, 279, 278; 52/182, 183; 108/92, 108/101, 42

See application file for complete search history.

(56) References Cited

U.S. PATENT DOCUMENTS

| | | | | |
|---|---|---|---|---|
| 454,772 | A * | 6/1891 | Sagar | 211/74 |
| 731,710 | A * | 6/1903 | Renken | 211/74 |
| 2,129,396 | A * | 9/1938 | Archer | 312/234 |
| 5,095,649 | A * | 3/1992 | Brownlee | 47/41.01 |
| 5,495,954 | A * | 3/1996 | Schmit | 211/90.04 |
| 5,570,540 | A * | 11/1996 | Womack et al. | 47/39 |
| 5,875,593 | A * | 3/1999 | Glockner | 52/183 |
| D407,994 | S * | 4/1999 | Adinolfi et al. | D11/143 |
| 5,915,602 | A | 6/1999 | Nelson | |
| 6,213,575 | B1 | 4/2001 | Brin et al. | |
| 7,036,668 | B2 * | 5/2006 | Udy | 211/70.6 |
| 2007/0103040 | A1 * | 5/2007 | Barrett et al. | 312/279 |

FOREIGN PATENT DOCUMENTS

| | | |
|---|---|---|
| FR | 2 287 195 | 5/1976 |
| GB | 2337929 | 12/1999 |
| GB | 2 389 519 | 12/2003 |
| JP | 08 001550 | 1/1996 |
| JP | 2002 034671 | 2/2002 |
| WO | WO 92/09771 | 6/1992 |

OTHER PUBLICATIONS

Australian Patent Office Search Report.
Australian Patent Office Examination Report.
EP Application No. 06123847.3: Communication pursuant to Article 94(3), Jan. 14, 2008.
EP Application No. 06123847.3: Response to Communication pursuant to Article 94(3), Apr. 29, 2008.
EP Application No. 06123847.3: Communication pursuant to Article 94(3), Apr. 14, 2009.
EP Application No. 06123847.3: Response to Communication pursuant to Article 94(3), May 11, 2009.

* cited by examiner

*Primary Examiner*—Janet M Wilkens
(74) *Attorney, Agent, or Firm*—Alston & Bird LLP

(57) ABSTRACT

A bar counter (100) for use standing across a relatively upper floor (10) and a relatively lower floor (13) interconnected by steps (11 and 12), comprises a body (110) having a first side (110R) on the upper floor (10) and an opposite second side (110F) on the lower floor (13). The body (110) has a bottom (120) adapted to engage said upper and lower floors (10 and 13) and includes a top (130) having a relatively higher horizontal surface (130H) on the first side (110R) and a relatively lower horizontal surface (130L) on the second side (110F), for use by people on opposite sides of the counter (100).

4 Claims, 6 Drawing Sheets

SPLIT-LEVEL BAR COUNTER

The present invention relates to a bar counter by which people can stand and drink/chat.

BACKGROUND OF INVENTION

People like to gather around a bar counter to drink and chat, socializing themselves with the others. There has been little attention paid to the design of bar counters to cater for the general difference in height of people, especially between men and women.

The invention seeks to provide a new or otherwise improved bar counter which allows people to stand and drink/chat more comfortably.

SUMMARY OF THE INVENTION

According to the invention, there is provided a bar counter for use standing across a relatively upper floor and a relatively lower floor interconnected by at least one step, comprising a body having a first side on said upper floor and an opposite second side on said lower floor. The body has a bottom adapted to engage at least one of said upper and lower floors and includes a top having a relatively higher horizontal surface on the first side and a relatively lower horizontal surface on the second side, for use by people on opposite sides of the counter.

Preferably, the bottom of the body is adapted to engage both of said upper and lower floors.

More preferably, the bottom of the body has a first portion on the first side for engaging said upper floor and a second portion on the second side for engaging said lower floor.

In a preferred embodiment, the bottom of the body has a lowermost profile matching with the surface profile of said upper and lower floors and at least one step.

It is preferred that at least one of the higher and lower horizontal surfaces of the top of the body extends along the corresponding side of the body, over generally the entire length of that side.

It is further preferred that at least one of the higher and lower horizontal surfaces of the top of the body occupies generally the entire width of the corresponding side of the body, in a direction transversely of that side.

Advantageously, at least one of the higher and lower horizontal surfaces of the top of the body includes a retaining member along at least part of its periphery.

More advantageously, the retaining member extends along left and right edges and an inner edges of the horizontal surface.

Conveniently, the first and second sides of the body have generally the same height.

In a specific construction, the body includes two separate upright members at left and right ends of the counter, which have respective said bottoms adapted to engage said upper and lower floors and across which the top extends.

More specifically, the top has two separate elongate parts extending individually across the two members of the body, one part being at a relatively higher level providing the higher horizontal surface and the other at a relatively lower level providing the lower horizontal surface.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
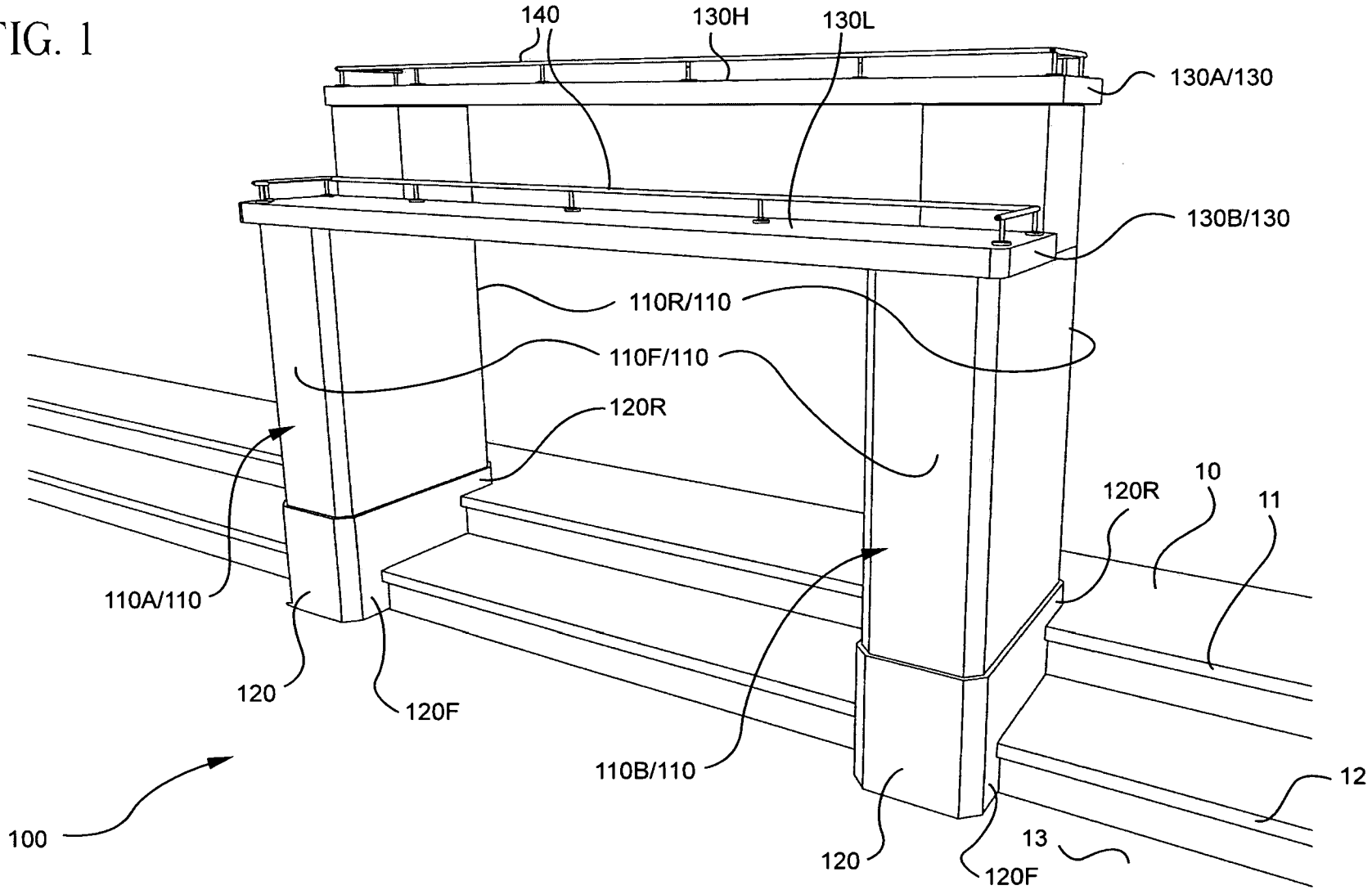
FIG. 1 is a front perspective view of an embodiment of a bar counter in accordance with the invention.

Referring to the drawings, there is shown a bar counter (or bar) 100 embodying the invention for use standing across a relatively upper floor 10 and a relatively lower floor 13 interconnected by one or two steps 11 and 12. The bar counter 100 comprises a body 110 having a rear side 110R on the upper floor 10 and an opposite, front side 110F on the lower floor 13. The body 110 has a bottom 120 adapted to engage or stand on at least one or, preferably, both of the upper and lower floors 10 and 13.

The counter body 110 includes a top 130 which has a relatively higher horizontal surface 130H on the rear side 110R and a relatively lower horizontal surface 130L on the front side 110F, for use by people (of different height) on opposite sides of the bar 100. The rear side 110R is taller than the front side 110F generally stated, but they have about the same height when measured from their corresponding footings.

The counter body 110 includes two separate upright pillars 110A and 110B at left and right ends of the counter 100, which have respective bottoms 120 adapted to stand on the upper and lower floors 10 and 13 and across which the top 130 extends. The top 130 is provided by two separate elongate shelves 130A and 130B extending individually across the two pillars 110A and 110B, with one shelf 130A being located at a relatively higher level providing the higher surface 130H and the other 130B at a relatively lower level providing the lower surface 130L. This renders the bar top 130 having a pair of spilt-level tops 130A and 130B.

Figure 3:
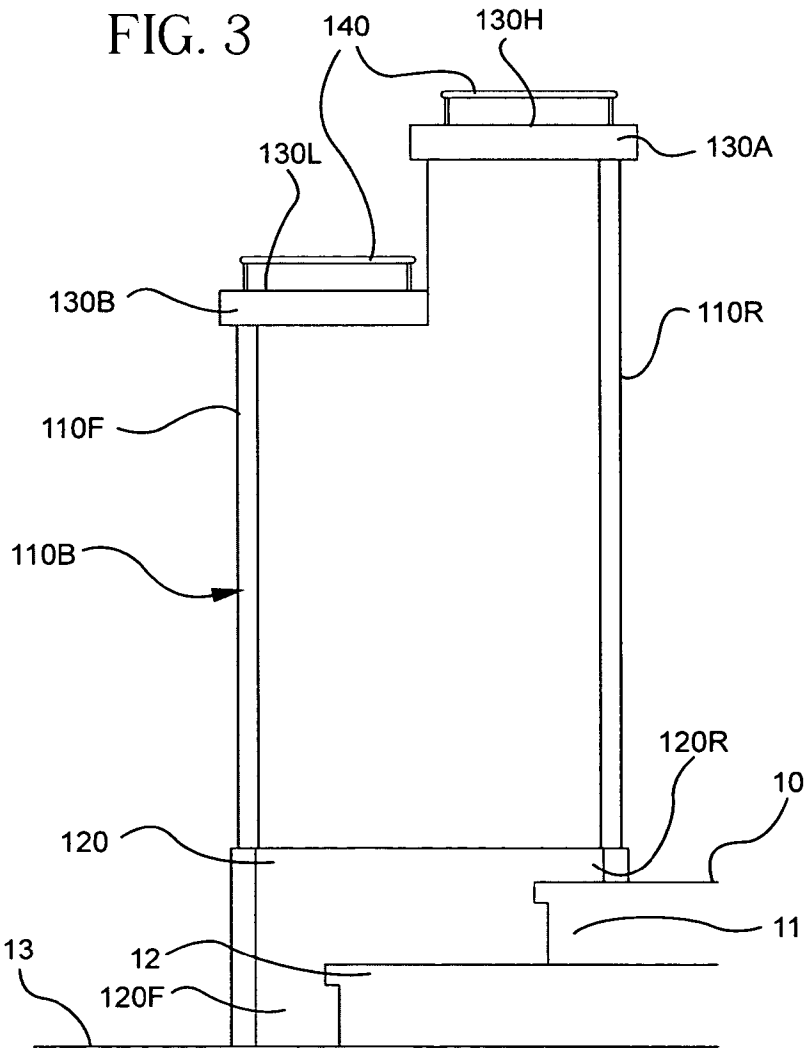
FIG. 3 is a right side view of the bar counter of FIG. 1.
Figure 2:
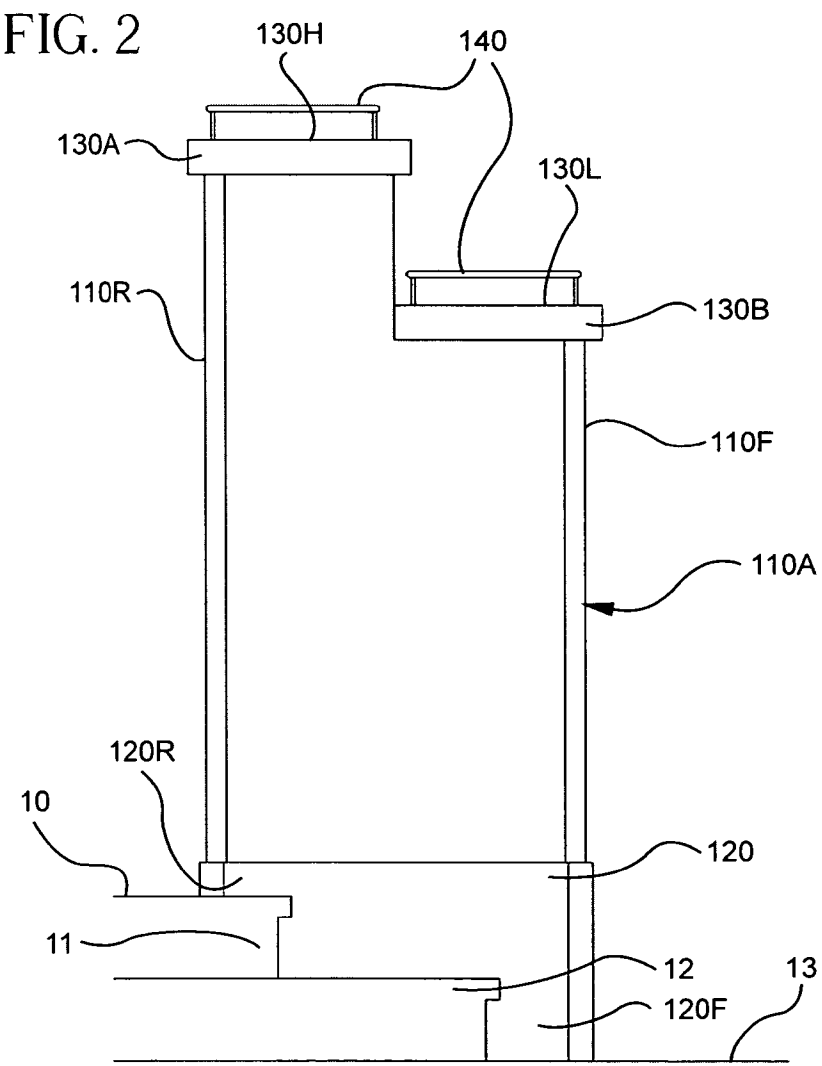
FIG. 2 is a left side view of the bar counter of FIG. 1.
Figure 4:
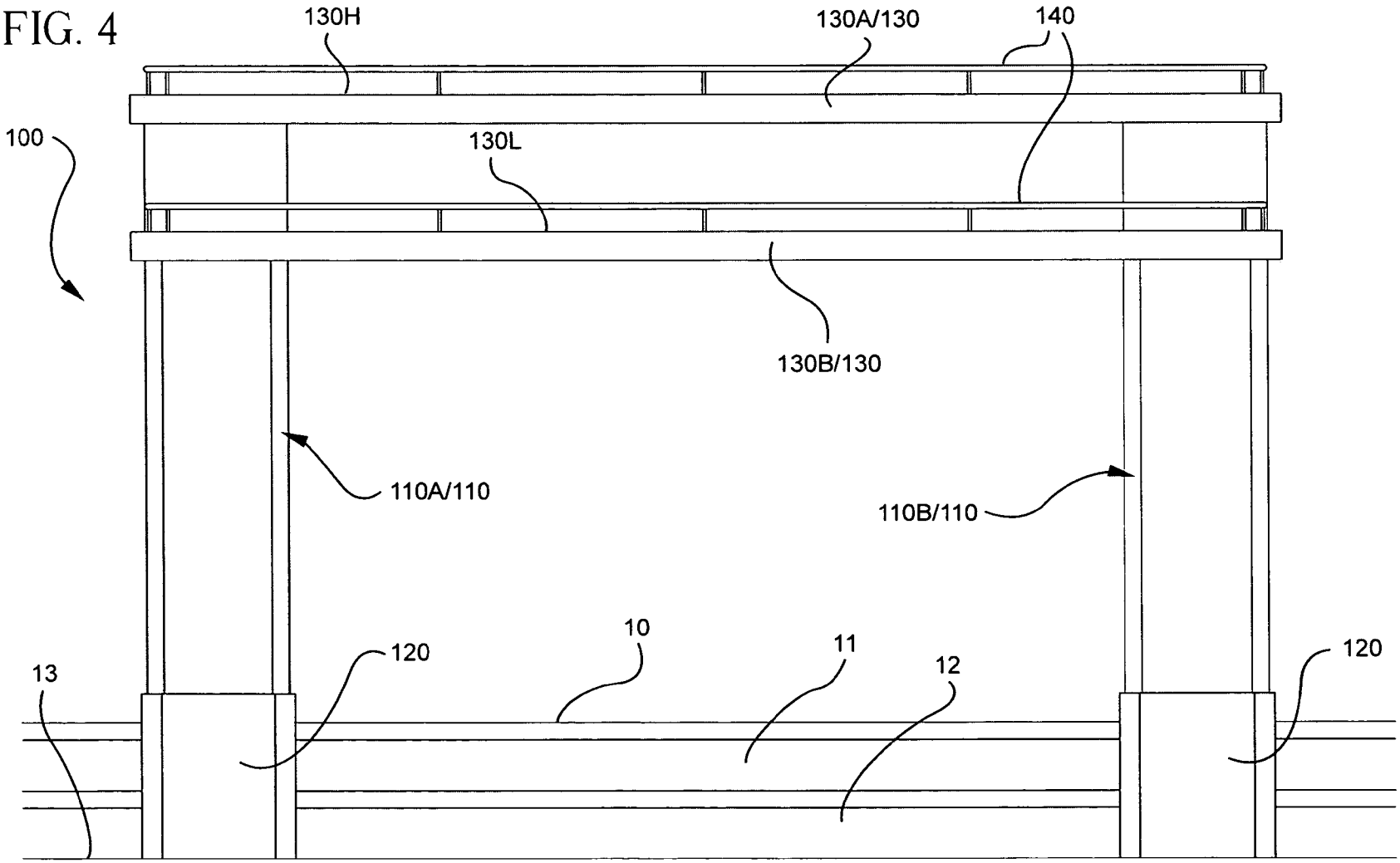
FIG. 4 is a front view of the bar counter of FIG. 1.
Figure 5:
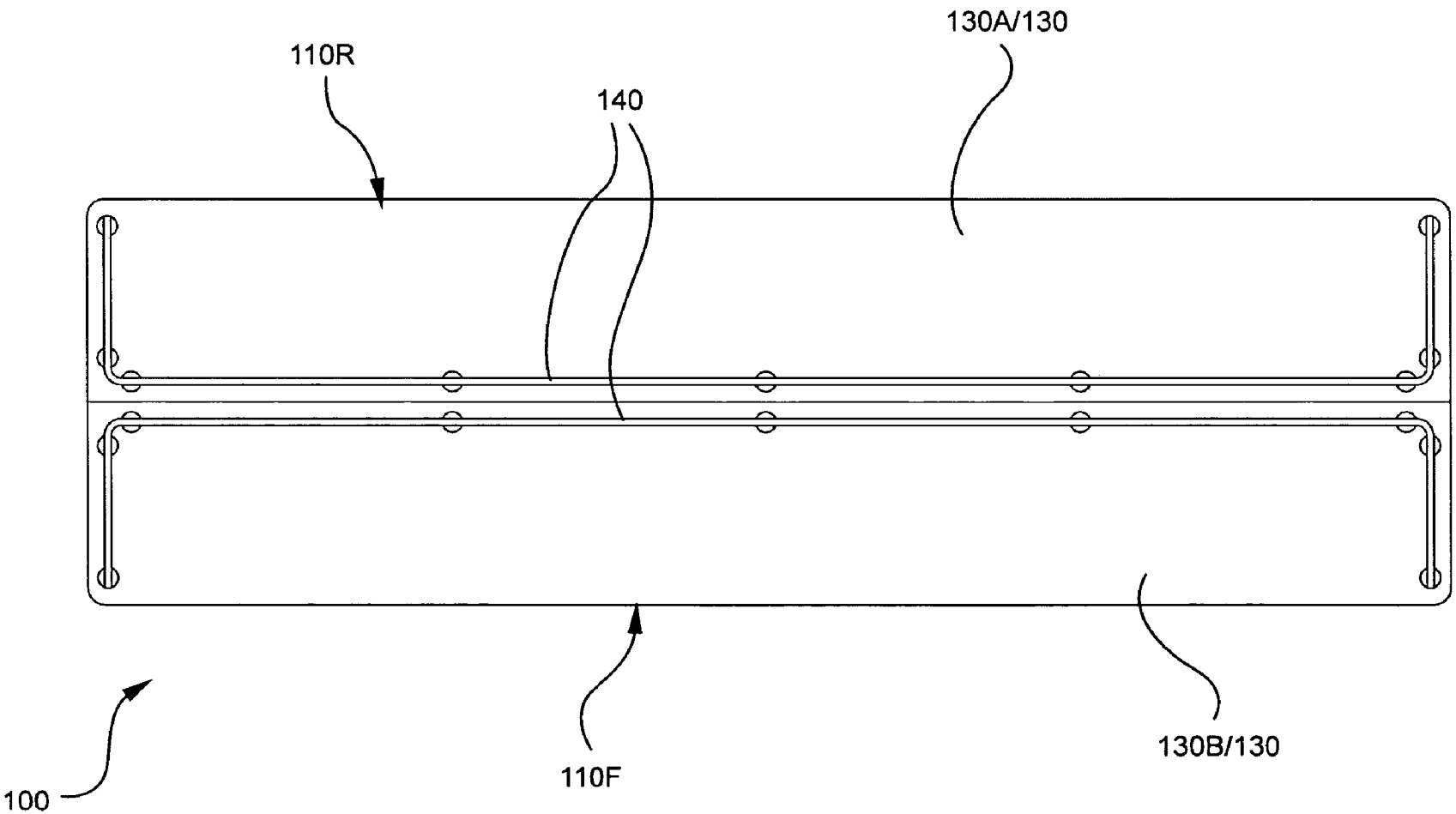
FIG. 5 is a top plan view of the bar counter of FIG. 1.
Figure 6:
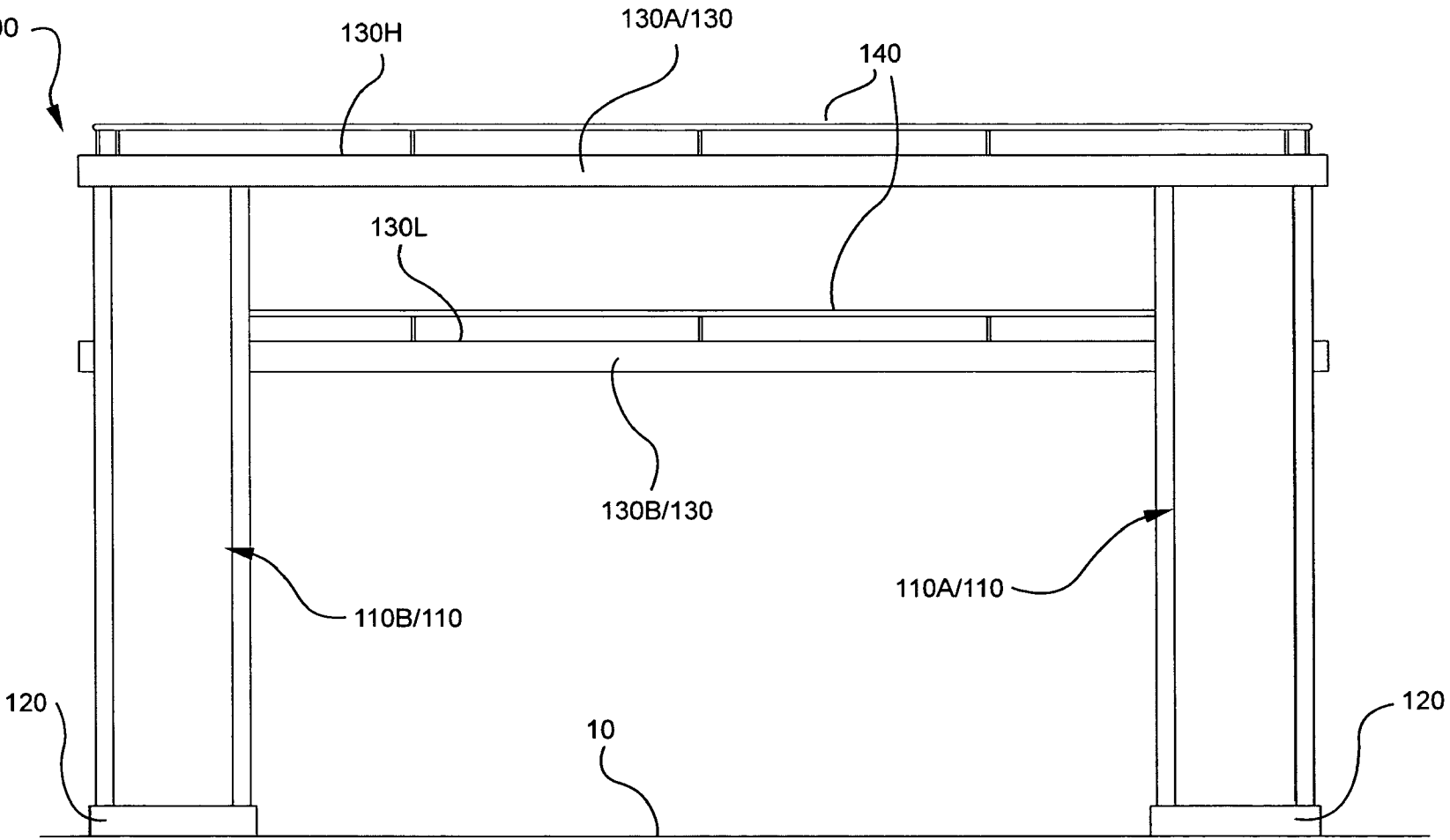
FIG. 6 is a rear view of the bar counter of FIG. 1.
Figure 7:
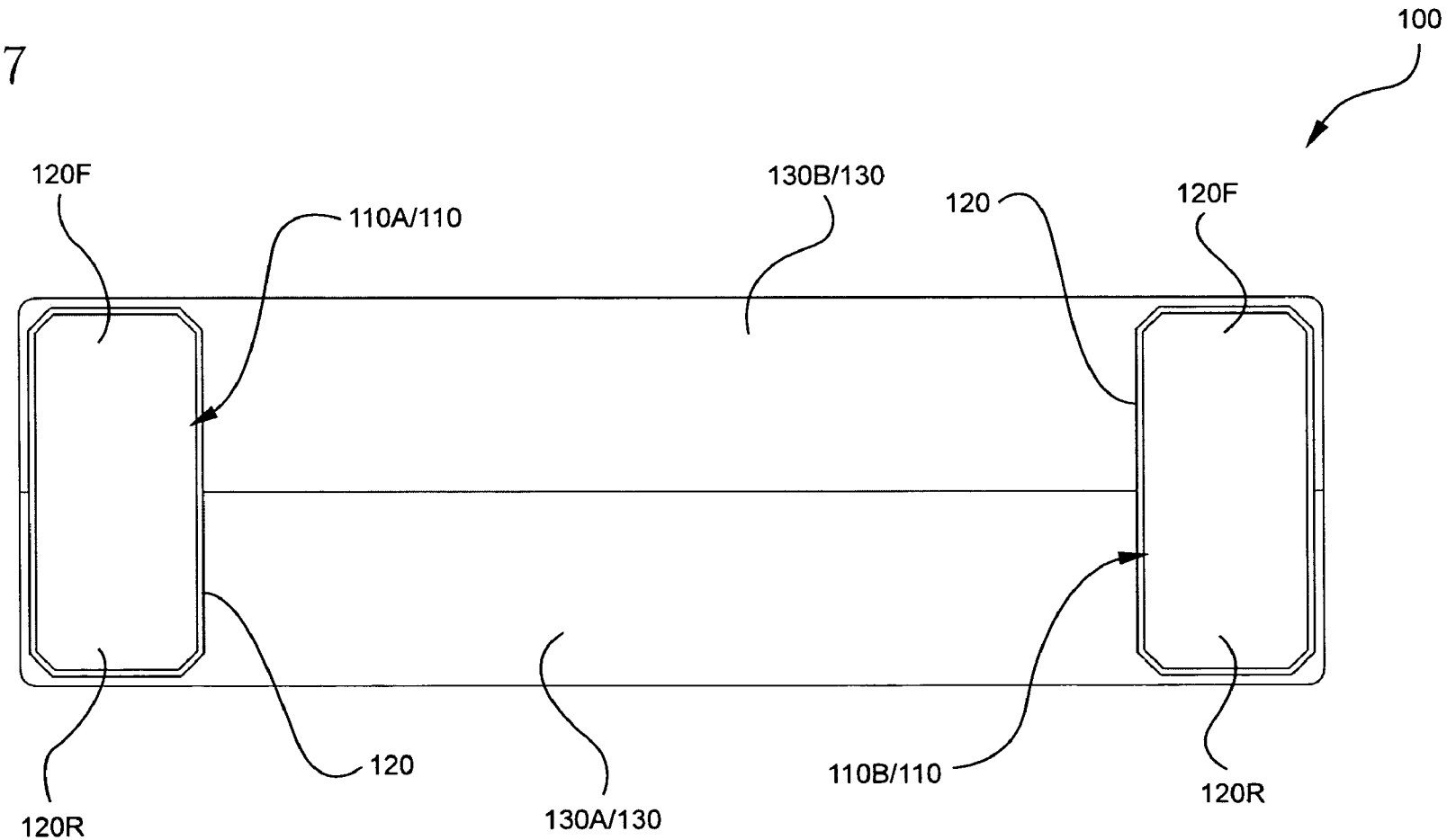
FIG. 7 is a bottom plan view of the bar counter of FIG. 1.

The bottom 120 of each pillar 110A/110B of the body 110 has a rear portion 120R on the rear side 110R for engaging the upper floor 10 and a front portion 120F on the front side 110F for engaging the lower floor 13. To achieve a neat appearance, the bottom 120 has a stepped lowermost profile to match with and fit the stepped surface profile of the upper and lower floors 10 and 13 and the steps 11 and 12, as shown in FIGS. 1 to 3.

Each of the higher and lower horizontal surfaces 130H and 130L of the top shelves 130A and 130B extends along the corresponding side 110R/110F of the body 110, over generally the entire length of that side 110R/110F. Also, each surface 130H/130L occupies generally the entire width of the corresponding side 110R/10F, in a direction transversely of that side 110R/110F.

A retaining member in the form of a railing 140 is provided on each of the higher and lower horizontal surfaces 130H and 130L, extending along at least part of its periphery i.e. the left and right edges and an inner edge of the surface 130H/130L. The railing 140 serves to retain objects, such as drinks and glasses, on the surface 130H/130L.

The bar counter 100 is not just conveniently built on the steps 11 and 12—it is purposefully built on the steps 11 and 12 to provide the split-level tops 130A and 130B such that people of different height can stand on and use opposite sides 110F and 110R of the counter 100.

Whilst there is normally a difference in height between men and women, when they chat they usually like to not only keep a distance but also face at the same or similar eye level. The wisdom behind the split-level bar 100 is that it allows the women (or relatively shorter people) to stand on the upper floor 10 or the taller side 110R of the bar 100 to chat to the men (or relatively taller people) who usually stand on the lower floor 13 or the shorter side 110F. In doing so, they can chat at more or less the same height or eye level and yet still keep within their boundaries and comfort zone.

It is envisaged that the bar body 110 may be solid across its left and right ends or, in a different aspect, it may be built to stand on only the upper or the lower floor 10/13 preferably right at the edge of either one step 11/12 as appropriate.

The invention has been given by way of example only, and various other modifications of and/or alterations to the described embodiment may be made by persons skilled in the art without departing from the scope of the invention as specified in the appended claims.

The invention claimed is:

1. A bar counter for standing across a relatively upper floor and a relatively lower floor interconnected by at least one step, comprising:

first and second elongate tops extending along opposing first and second sides of the bar counter respectively, the first top being a relatively upper horizontal surface and the second top being a relatively lower horizontal surface;

two upright pillars supporting the elongate tops, wherein the pillars are disposed at longitudinally opposing ends of the counter, each pillar extending transversely between opposing first and second sides of the counter, each pillar having a bottom with a stepped lower profile, such that the first and second tops are adapted to be disposed at generally the same height from the upper and lower floors, respectively; and first and second retaining members raised above and extending partially around the periphery of the first and second tops respectively.

2. A bar counter for standing across a relatively upper floor and a relatively lower floor interconnected by at least one step, comprising:

first and second elongate tops extending along opposing first and second sides of the bar counter respectively, the first top being a relatively upper horizontal surface and the second top being a relatively lower horizontal surface;

two upright pillars supporting the elongate tops, wherein the pillars are disposed at longitudinally opposing ends of the counter, each pillar extending transversely between opposing first and second sides of the counter, each pillar having a bottom with a stepped lower profile, such that the first and second tops are adapted to be disposed at generally the same height from the respective upper and lower floors; and first and second railings raised above and extending partially around the periphery of the first and second tops respectively.

3. A bar counter for standing across a relatively upper floor and a relatively lower floor interconnected by at least one step, the bar counter comprising:

first and second elongate shelves extending along opposing first and second sides of the bar counter respectively, the first shelf being a relatively upper horizontal surface and the second shelf being a relatively lower horizontal surface which are substantially rectangular;

two upright pillars supporting the elongate shelves, wherein the pillars are disposed at opposing ends of the counter, each pillar having a respective bottom with a stepped lowermost profile, such that the first and second shelves are adapted to be disposed at generally the same height from the respective upper and lower floors; and first and second railings raised above and extending partially around the periphery of the first and second shelves respectively, with an opening in the first railing on the first side and an opening in the second railing on the second side.

4. A bar counter standing across a relatively upper floor and a relatively lower floor interconnected by at least one step, comprising:

first and second elongate tops extending along opposing first and second sides of the bar counter respectively, the first top being a relatively upper horizontal surface and the second top being a relatively lower horizontal surface;

two upright pillars supporting the elongate tops, wherein the pillars are disposed at longitudinally opposing ends of the counter, each pillar extending transversely between opposing first and second sides of the counter, each pillar having a bottom with a stepped lower profile mating with the upper and lower floors and the at least one step, and wherein the first and second tops are disposed at generally the same height from the upper and lower floors, respectively; and first and second retaining members raised above and extending partially around the periphery of the first and second tops respectively.

* * * * *

UNITED STATES PATENT AND TRADEMARK OFFICE

CERTIFICATE OF CORRECTION

PATENT NO. : 7,717,044 B2
APPLICATION NO. : 11/801396
DATED : May 18, 2010
INVENTOR(S) : Hatton It is certified that error appears in the above-identified patent and that said Letters Patent is hereby corrected as shown below:

Column 2

Line 40, “spilt-level” should read --split-level--

Line 53, “110R/10F” should read --110R/110F--

Signed and Sealed this
Fourth Day of January, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,717,044 B2
APPLICATION NO. : 11/801396
DATED : May 18, 2010
INVENTOR(S) : Hatton It is certified that error appears in the above-identified patent and that said Letters Patent is hereby corrected as shown below:

Title Page

"(73) Assignee: Sparkling Wine International" should read

--(73) Assignee: Sparkling Wine International Ltd.--

Signed and Sealed this
Thirteenth Day of September, 2011

David J. Kappos

David J. Kappos
*Director of the United States Patent and Trademark Office*